US006990970B1

(12) United States Patent
Darlington

(10) Patent No.: US 6,990,970 B1
(45) Date of Patent: Jan. 31, 2006

(54) COMPOUND ARCHERY BOW

(76) Inventor: Rex F. Darlington, 6828 Maple Acres Dr., Whittemore, MI (US) 48770

( * ) Notice: Subject to any disclaimer, the term of this patent is extended or adjusted under 35 U.S.C. 154(b) by 0 days.

(21) Appl. No.: 10/927,764

(22) Filed: Aug. 27, 2004

Related U.S. Application Data

(60) Provisional application No. 60/498,122, filed on Aug. 27, 2003.

(51) Int. Cl.
*F41B 5/10* (2006.01)

(52) U.S. Cl. ..... 124/25.6; 124/900

(58) Field of Classification Search ..... 124/25, 124/25.6, 900
See application file for complete search history.

(56) References Cited

U.S. PATENT DOCUMENTS

| | | | |
|---|---|---|---|
| 3,990,425 | A | 11/1976 | Ketchum |
| 4,401,097 | A | 8/1983 | Simmonds |
| 4,438,753 | A | 3/1984 | Simmonds |
| 4,519,374 | A | 5/1985 | Miller |
| 4,774,927 | A | 10/1988 | Larson |
| 4,838,236 | A | 6/1989 | Kudlacek |
| 4,926,832 | A | 5/1990 | Darlington |
| 4,926,833 | A | 5/1990 | Darlington |
| 4,967,721 | A | 11/1990 | Larson |
| 4,976,250 | A | 12/1990 | Jeffrey |
| 4,986,250 | A | 1/1991 | Darlington |
| 5,092,309 | A | 3/1992 | Beaton |
| 5,301,651 | A | 4/1994 | LaBorde et al. |
| 5,368,006 | A | 11/1994 | McPherson |
| 5,433,792 | A | 7/1995 | Darlington |
| 5,505,185 | A | 4/1996 | Miller |
| 5,649,522 | A | 7/1997 | Troncoso |
| 5,678,529 | A | 10/1997 | Larson |
| 5,782,229 | A | 7/1998 | Evans et al. |
| 5,791,322 | A | 8/1998 | McPherson |
| 5,934,265 | A | 8/1999 | Darlington |
| 5,975,067 | A | 11/1999 | Strother |
| 6,082,347 | A | 7/2000 | Darlington |

(Continued)

FOREIGN PATENT DOCUMENTS

CA 2183305 2/1997

OTHER PUBLICATIONS

Mulloney, "One Step Beyond the Compound?" Archery World, Sep. 1976.

(Continued)

*Primary Examiner*—John A. Ricci
(74) *Attorney, Agent, or Firm*—Reising, Ethington, Barnes, Kisselle, P.C.

(57) ABSTRACT

A compound archery bow includes a handle having projecting limbs. A first pulley is mounted for rotation around a first axis on a first of the limbs, and a second pulley is mounted for rotation around a second axis on a second of the limbs. A bow cable arrangement extends between the pulleys, and includes a bowstring cable extending from bowstring let-out grooves in the first and second pulleys so that, as the bowstring cable is drawn away from the handle, the bowstring cable lets out or unwraps from the bowstring grooves and rotates the pulleys around the respective axes. First and second cables extend from cable take-up grooves on the respective pulleys to first and second cable let-out means on the respective opposite pulleys. Thus, as the bowstring cable is drawn away from the handle, the first and second cables are each taken up or wound at one end onto one of the pulleys and let out or unwound at the other end from the other pulley.

11 Claims, 16 Drawing Sheets

U.S. PATENT DOCUMENTS

| | | | |
|---|---|---|---|
| 6,112,732 | A | 9/2000 | Larson |
| RE37,544 | E | 2/2002 | Darlington |
| 6,516,790 | B1 | 2/2003 | Darlington |
| 6,666,202 | B1 | 12/2003 | Darlington |
| 6,688,295 | B1 | 2/2004 | Miller |

OTHER PUBLICATIONS

"Graham Take-Down Dynabo," Archery World, Jun./Jul. 1980.

Patent application of Larry D. Miller for "Archery Bow Assembly," date and serial No. unknown.

Alpine Archery Bow Manual, 1989.

"Instruction Manual—York Thunderbolt DynaBo," York Archery date unknown.

"M-10 Dynabo Draw Chart," Martin Archery, Inc. date unknown.

M-10 Cheetah DynaBo Owner's Manual, Martin Archery date unknown.

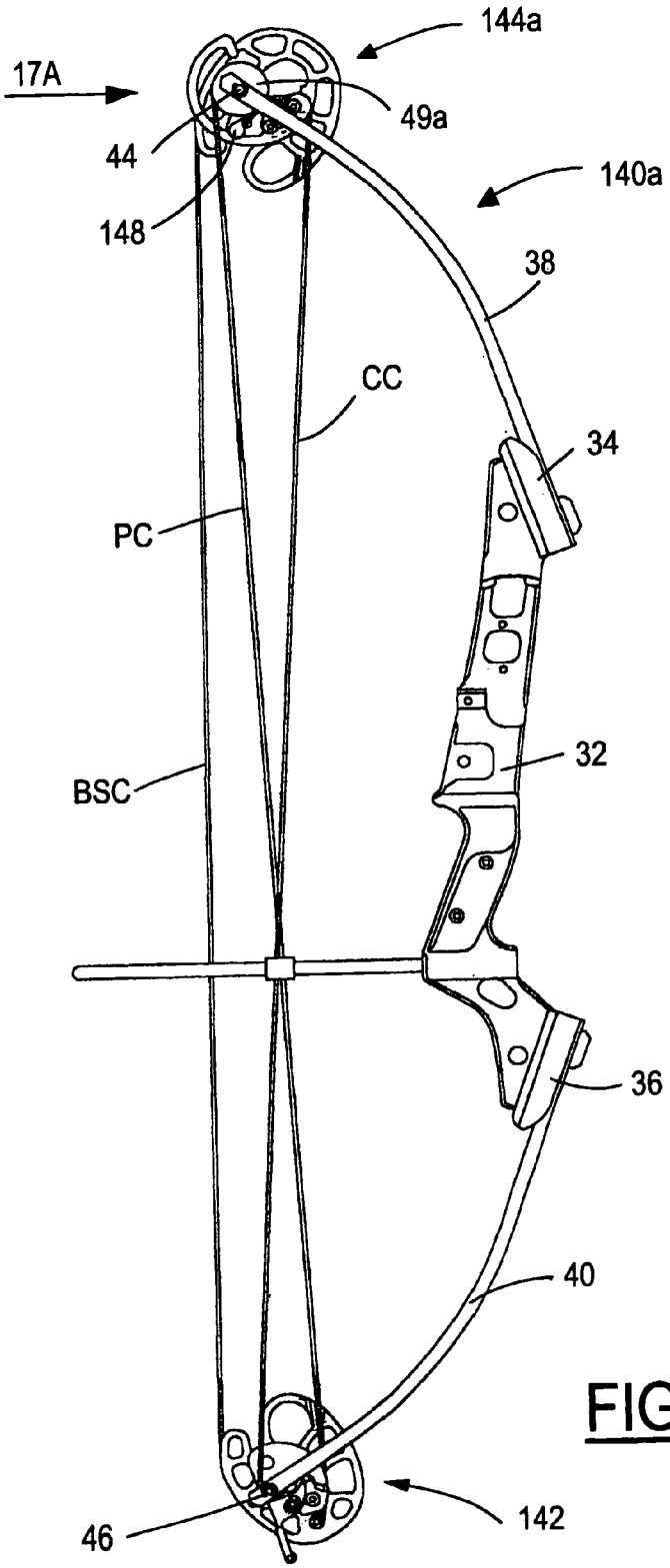
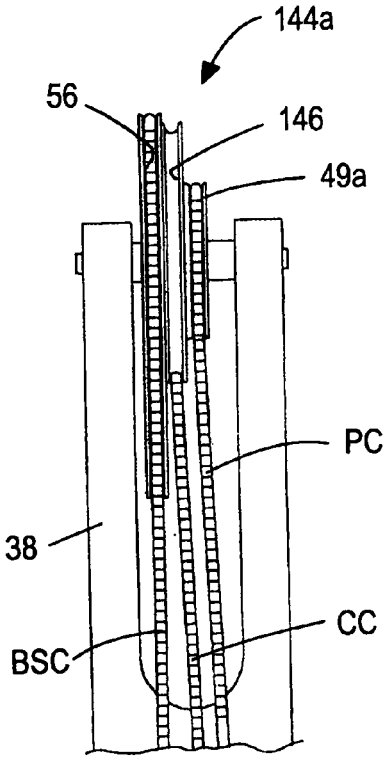
FIG. 17A
FIG. 16A

COMPOUND ARCHERY BOW

This application claims priority from application Ser. No. 60/498,122 filed Aug. 27, 2003.

The present invention is directed to compound archery bows having pulleys at the ends of the bow limbs to control the force/draw characteristics of the bow, and more particularly to both single-cam bows having a power let-off cam mounted on the end of one of the bow limbs and dual-cam bows having power let-off cams mounted on the ends of both bow limbs.

BACKGROUND AND SUMMARY OF THE INVENTION

Single-cam and dual-cam compound archery bows have power cams mounted on one or both ends of the bow limbs to control the draw force on the bowstring and the bending of the limbs as the bowstring is drawn. In single-cam bows, there is a power cam on the end of one bow limb, and a wheel on the end of the other bow limb to control or time take-up of a power cable at the power cam and let-out of the bowstring and control cables at the power cam as the bow is drawn. In dual-cam bows, power cams are mounted on the ends of both bow limbs, with each including groove segments to control let-out of the bowstring cable at the opposing cam. In conventional single-cam and dual-cam bows or crossbows, the power cables or cable segments are anchored near the end of one or both bow limbs, at the axles in most cases.

Briefly stated, in accordance with the presently preferred embodiments of the invention, the power cable or cable segment is anchored not to the end of a bow limb, but is trained around additional let-out means in the cam or control wheel at the end of the bow limb. This additional let-out means decreases limb movement as the power cam takes up the power cable during the power stroke, and allows the design of the power cam take-up groove to be larger and thereby facilitate use of larger radii in designing the cable path to reduce fatigue of the power cable. The additional let-out means also facilitates bow designs with increased pre-stress in the bow limbs while minimizing movement of the limbs during the power stroke, thereby reducing limb shock and increasing efficiency. This additional let-out means also facilitates additional control of the cam and/or cam wheel rotation between the upper and lower limbs because the additional cross-coupling forces the rotation to be in unison. As applied specifically to dual-cam bows and crossbows with draw stops on one or both cams, the invention permits continued rotation at both cams until the draw stops are engaged at both cams.

A compound archery bow in accordance with a first aspect of the invention includes a handle having projecting limbs. (The term "compound archery bow," as employed in this application, encompasses both compound traditional bows (e.g., FIGS. 1–19) and compound crossbows (e.g., FIGS. 20–22A).) A first pulley is mounted for rotation around a first axis on a first of the limbs, and a second pulley is mounted for rotation around a second axis on a second of the limbs. In single-cam bows, one of the pulleys is a control wheel and the other pulley is a power cam. In dual-cam bows, the pulleys are respective power cams. A bow cable arrangement extends between the pulleys, and includes a bowstring cable extending from bowstring let-out grooves in the first and second pulleys so that, as the bowstring cable is drawn away from the handle, the bowstring cable lets out or unwraps from the bowstring grooves and rotates the pulleys around the respective axes.

First and second cables extend from cable take-up grooves on the respective pulleys to first and second cable let-out means on the respective opposite pulleys. Thus, as the bowstring cable is drawn away from the handle, the first and second cables are each taken up or wound at one end onto one of the pulleys and let out or unwound at the other end from the other pulley. The let-out means preferably comprises at least one groove from which the cable is let-out or unwrapped as the cable is drawn. This let-out groove preferably is circular and concentric with the axis of pulley rotation but can be non-circular and/or non-concentric with the axis of rotation. In some embodiments, the let-out grooves are disposed on opposite sides of the bowstring let-out groove for improved balance. The let-out means alternatively may comprise one or more posts mounted on the pulley and offset from the axis of pulley rotation.

BRIEF DESCRIPTION OF THE DRAWINGS

The invention, together with additional objects, features, advantages and aspects thereof, will be best understood from the following description and the accompanying drawings, in which:

FIGS. 16A and 17A are elevational views that are respectively similar to those in FIGS. 16 and 17 but illustrate a modification to the embodiment of FIGS. 16–17;

DETAILED DESCRIPTION OF PREFERRED EMBODIMENTS

Figure 1:
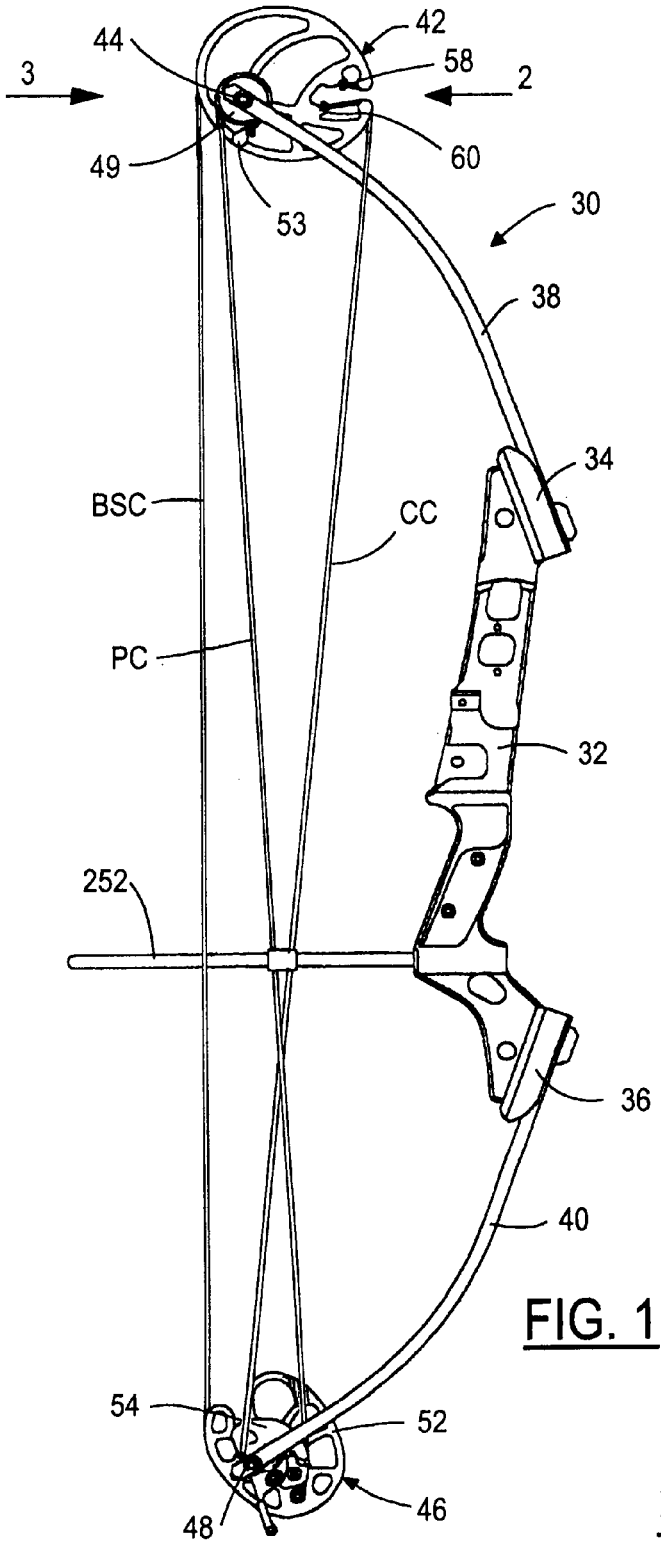
FIG. 1 is a side elevational view of a single-cam compound archery bow in accordance with one presently preferred embodiment of the invention.
Figure 2:
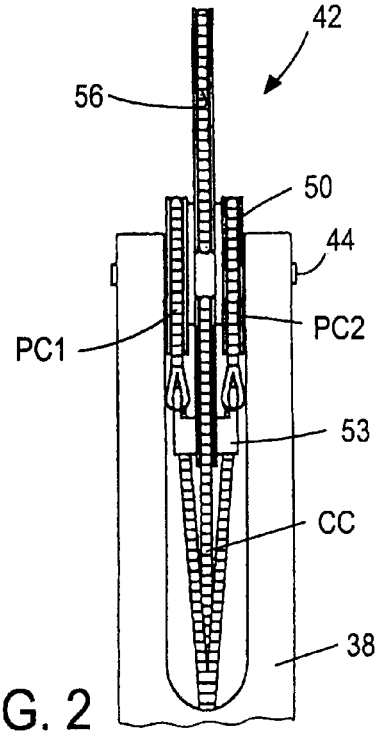
FIGS. 2 and 3 are fragmentary elevational views taken substantially from the respective directions 2 and 3 in FIG. 1.
Figure 3:
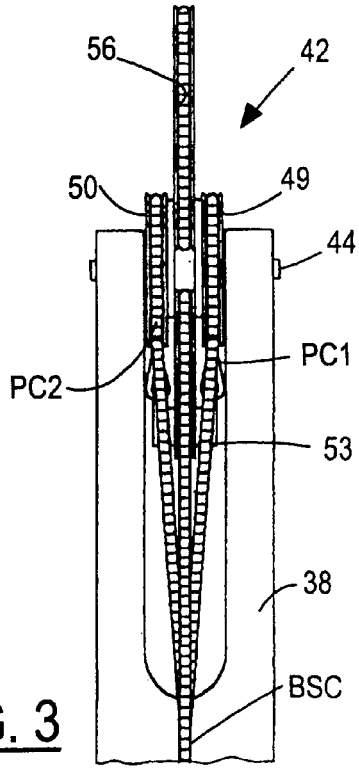
Figure 1A:
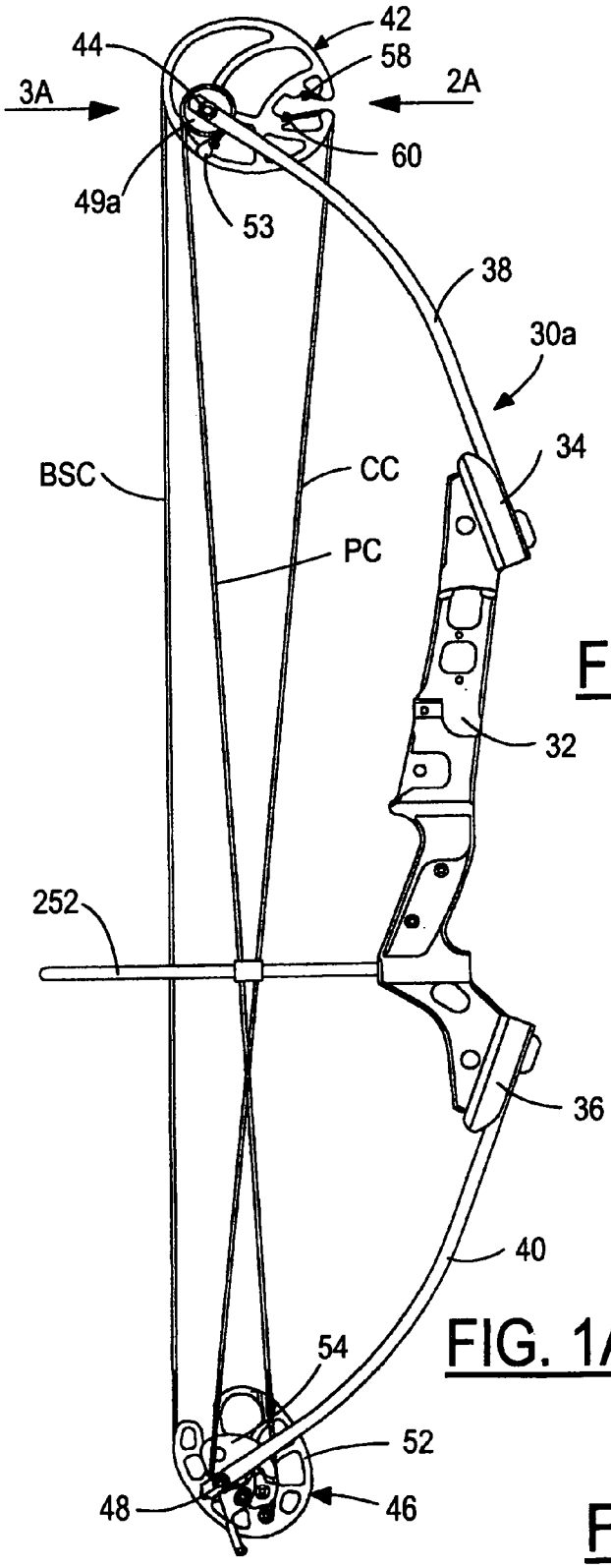
FIGS. 1A, 2A and 3A are views respectively similar to those in FIGS. 1, 2 and 3 but illustrating a modification to the embodiment of FIGS. 1–3.
Figure 2A:
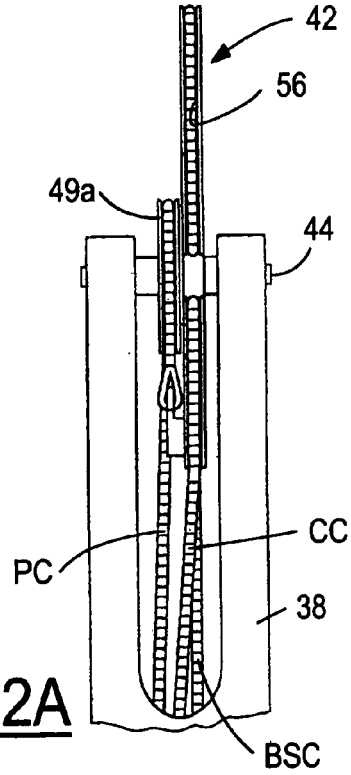
Figure 3A:
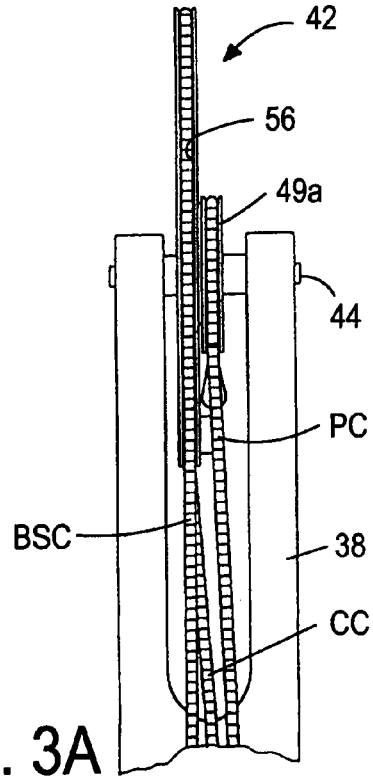

FIGS. 1–3 illustrates a single-cam compound archery bow 30 in accordance with one presently preferred embodiment of the invention as comprising a handle 32 of aluminum or other relatively rigid construction having spaced risers 34, 36 with a limb-mounting surface at each end. A pair of flexible resilient limbs 38, 40 of fiber-reinforced resin or other suitable resilient construction are mounted on respective handle risers 34, 36 and project away from handle 32. A control wheel 42 is mounted on an axle 44 that extends laterally across the free end of bow limb 38, such that control wheel 42 is mounted for rotation around a first axis within an open space or bracket at the free end of limb 38. Likewise, a power cam 46 is mounted on an axle 48 that extends laterally across the free end of limb 40, such that power cam 46 is mounted for rotation around a second axis within a notch or bracket at the free end of limb 40. Control wheel 42 and power cam 46 may be rotatable on axles 44, 48, or the axles may be secured to the control wheel and/or power cam and rotatable on the limbs. The positions of control wheel 42 and power cam 46 can, of course, be reversed.

A control cable CC is anchored at one end to control wheel 42 and at an opposing end to power cam 46. Likewise, a bowstring cable BSC is anchored at opposing ends to control wheel 42 and power cam 46. An arrow is to be nocked on bowstring cable BSC between control wheel 42 and power cam 46. Power cam 46 comprises a cam base 52, which preferably although not necessarily has a draw-length adjustment module 54 mounted thereon with a take-up groove to load the opposite limb through power cable PC. Power cam 46 is similar to a cam illustrated in U.S. Pat. No. 6,516,790, the disclosure of which is incorporated herein by reference for further discussion of the power cam assembly and operation of the overall bow. A power cable PC is anchored at power cam 46 and extends across bow 30 to control wheel 42. Control wheel 42 has a pair of pulleys 49, 50 disposed on laterally opposed sides of the control wheel. Pulleys 49, 50 may be formed integrally with control wheel 42, or may be separately made and pinned or otherwise secured to the control wheel. The end of power cable PC is split at PC1, PC2, and the split ends of the power cable are wound around pulleys 49, 50 respectively. (In the embodiment of FIGS. 1A–3A, a single pulley 49*a* combines the functions of pulleys 49, 50 in FIGS. 1–3, and power cable PC is not split and is wound around pulley 49*a*.). The split ends PC1, PC2 of the power cable are anchored at 53 to control wheel 42. The peripheral power cable let-out grooves in pulleys 49, 50 preferably are circular and concentric with the axis of rotation at axle 44 as illustrated in FIGS. 1–3, but can be non-circular and/or non-concentric with the axis of control wheel rotation.

Control wheel 42 has a single circular or non-circular peripheral groove 56 with a center or axis that preferably is offset from the axis of axle 44. Peripheral groove 56 lies in a plane that is perpendicular to the axis of axle 44. Bowstring cable BSC extends clockwise (in FIG. 1) around the periphery of groove 56 and is anchored to control wheel 42 at a post 58. Control cable CC extends at wheel 42 counterclockwise through a small tangential portion of groove 56 (in the rest position of the bow and the orientation illustrated in FIG. 1), and is anchored to control wheel 42 at a post 60. There thus is a gap in peripheral groove 56 through which cables BSC and CC extend to respective anchor posts 58, 60, which are mounted to the body of the control wheel inwardly of the gap. As a modification to the embodiment illustrated in FIG. 1, control cable CC and bowstring cable BSC may comprise a single length of cable that is suitably anchored to the control wheel.

Thus, as bowstring cable BSC is drawn, the effective radius of groove 56 from axle 44 continuously changes. Both the bowstring cable and the control cable travel in groove 56. The bowstring cable is let out as the bow is drawn, and the control cable is taken up in the same groove. At some point, the control cable may enter a segment of the groove that previously was occupied by the bowstring cable in the rest position of the bow. The control wheel configuration illustrated in FIG. 1 provides more control of the let-out of the bowstring while maintaining better control of nock point travel and making it easier to achieve more stored energy in the bow. Wrapping into and unwrapping from a single peripheral groove at the periphery of control wheel 42 also reduces torsional stresses on the axle that would otherwise be associated with wrapping into and unwrapping from laterally adjacent grooves on the control wheel. The additional power cable let-out grooves at pulleys 49, 50 on both sides of the central control wheel groove 56 accomplishes the objectives of the invention set forth above, and gives improved limb balance and timing control. Groove 56, which is the take-up groove for cable CC (as well as the let-out groove for cable BSC) preferably is non-circular. Disposition of cables PC1 and PC2 in let-out grooves on opposite sides of groove 56 balances the forces applied to axle 44 and reduces torsion in limb 38.

Figure 4:
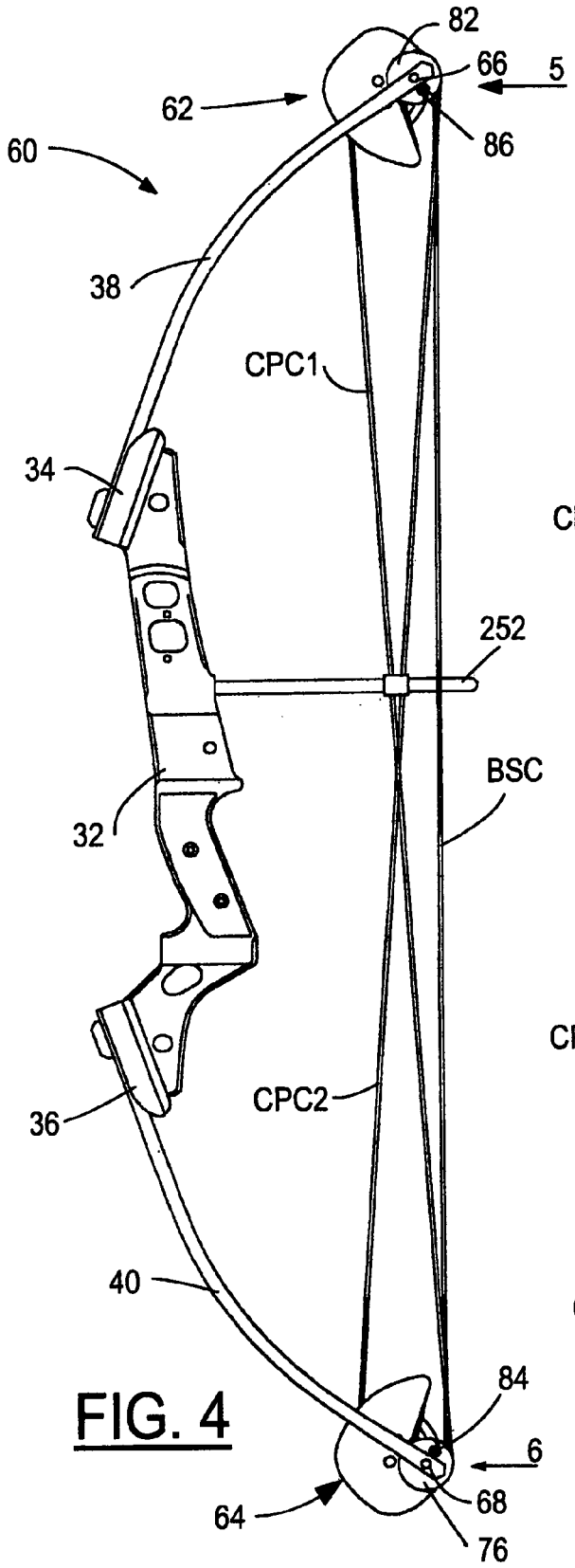
FIG. 4 is a side elevational view of a dual-cam bow in accordance with another preferred embodiment of the invention.
Figure 5:
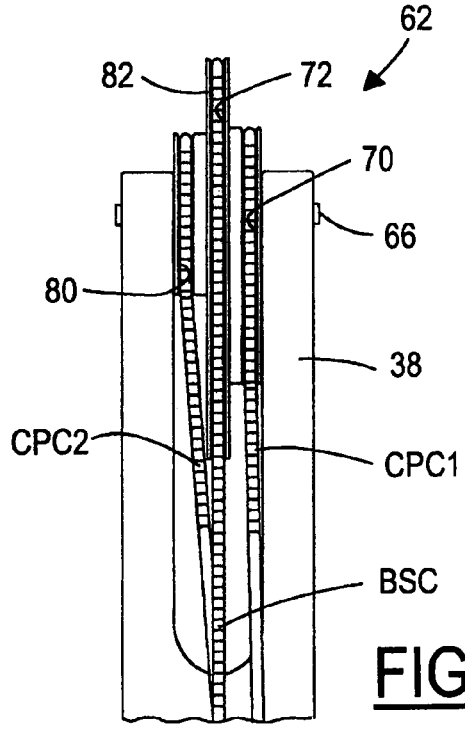
FIGS. 5 and 6 are fragmentary elevational views taken from the respective directions 5 and 6 in FIG. 4.
Figure 6:
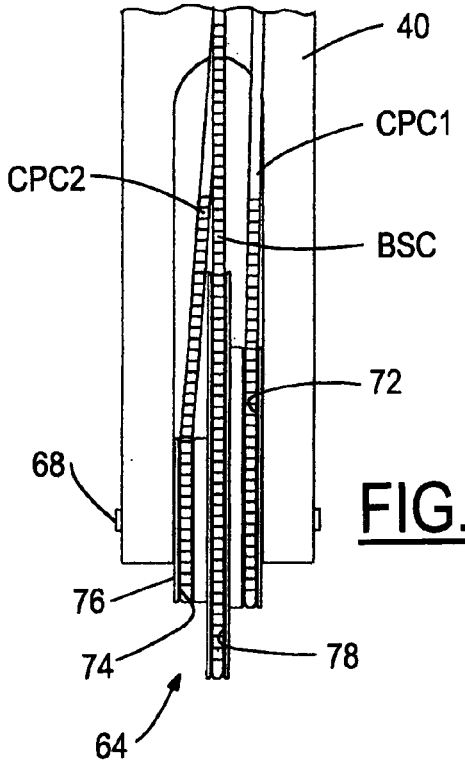
Figure 4A:
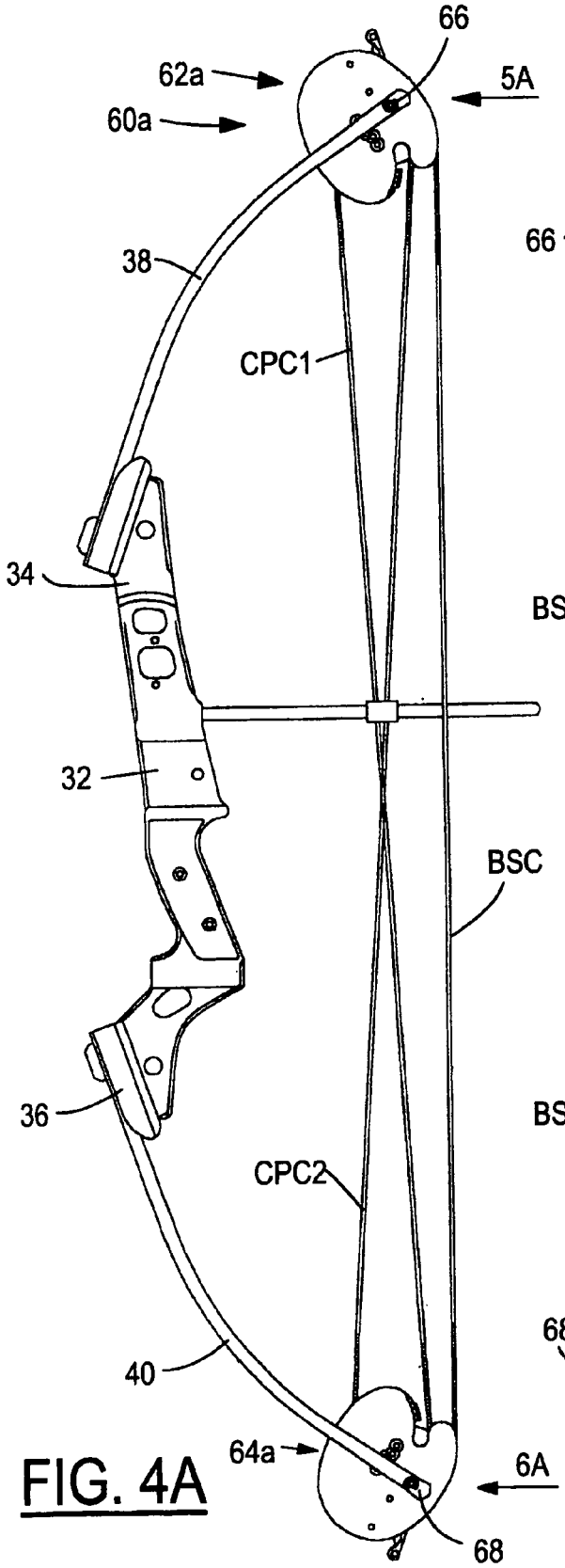
FIGS. 4A, 5A and 6A are views respectively similar to those in FIGS. 4, 5 and 6 but illustrating a modification to the embodiment of FIGS. 4–6.
Figure 5A:
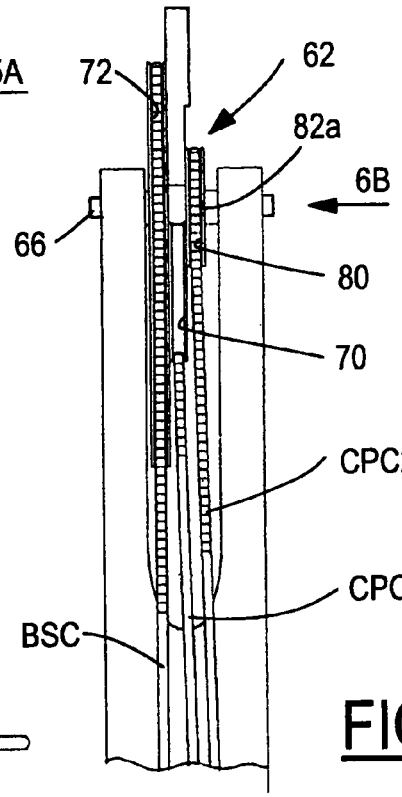
Figure 6A:
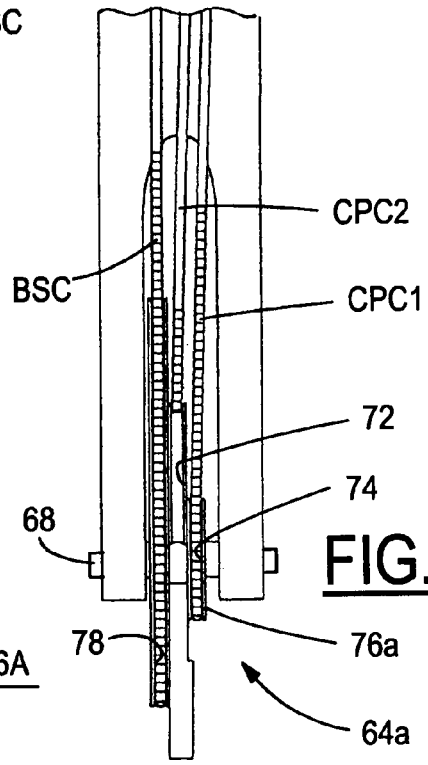

FIGS. 4–6 illustrate a dual-cam compound archery bow 60 in accordance with another embodiment of the invention. Power cams 62, 64 are mounted by corresponding axles 66, 68 at the ends of respective bow limbs 38, 40. A bowstring cable BSC extends between let-out grooves 72, 78 on the respective cams 62, 64. A first control/power cable CPC1 extends from a take-up groove 70 on power cam 62 to a let-out groove 74 on a pulley 76 at power cam 64. Likewise, a second control/power cable CPC2 extends from a take-up groove 72 at power cam 64 across bow 60 to a let-out groove 80 on a pulley 82 secured to power cam 62. Cables CPC1, CPC2 are anchored at 84, 86 to pulleys 76, 82 respectively. As in the embodiment of FIGS. 1–3, the grooves 74, 80 of pulleys 76, 82 are circular and concentric with the respective axes of rotation at axles 68, 66, but may be non-circular and/or non-concentric if desired. Disposition of cables CPC1 and CPC2 in grooves 70, 80 on opposite sides of groove 72 at cam 62, and in grooves 72, 74 on opposite sides of groove 78 at cam 64, reduces torsion on limbs 38, 40.

Figure 6B:
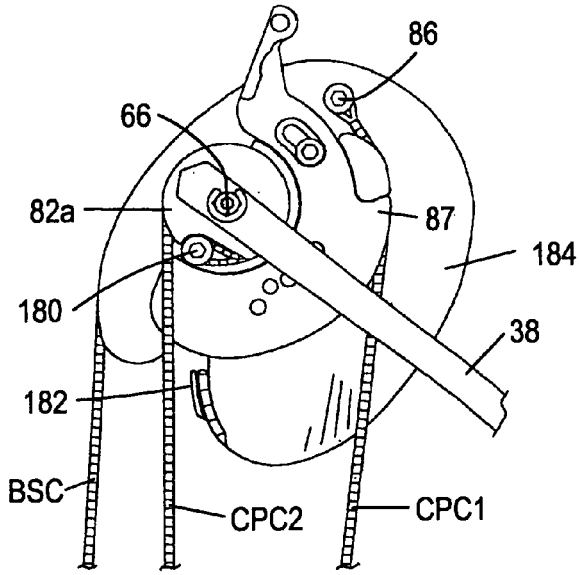
FIG. 6B is a fragmentary elevational view taken substantially from the direction 6B in FIG. 5A.

FIGS. 4A, 5A, 6A and 6B illustrate a bow 60*a* having power cams 62*a*, 64*a*. In the power cams of FIGS. 4A, 5A, 6A and 6B, the bowstring let-out grooves 72, 74 are on one side of the cams, rather than being positioned in the middle of the cams in FIGS. 5 and 6. Let-out groove 80 for cable CP2 is positioned on the opposing side of cam 62*a*, and take-up groove 70 for cable CP1 on cam 62*a* is positioned between grooves 72, 80. Likewise, let-out groove 74 for cable CP1 at cam 64*a* is positioned on a side of cam 64*a* opposite bowstring let-out groove 74, and take-up groove 72 for cable CPC2 at cam 64*a* is positioned between grooves 74,78. As shown in FIG. 6B, cable CPC1 is anchored at 86 at cam 62*a* after passing around an adjustable draw length module 87, and cable CPC2 is anchored at 180 on pulley 82*a*. Bowstring cable BSC is anchored at 182 on base 184 of cam 62*a*.

Figure 7:
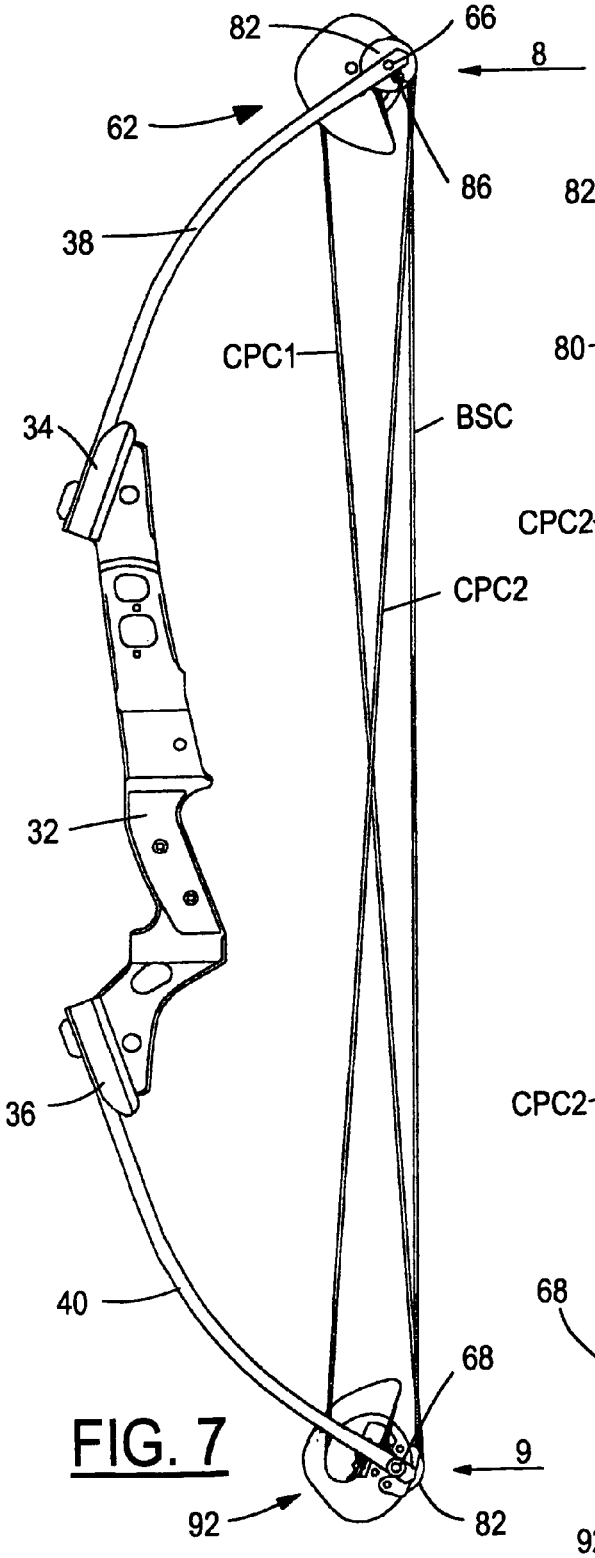
FIG. 7 is a side elevational view of a dual-cam bow in accordance with yet another presently preferred embodiment of the invention.
Figure 8:
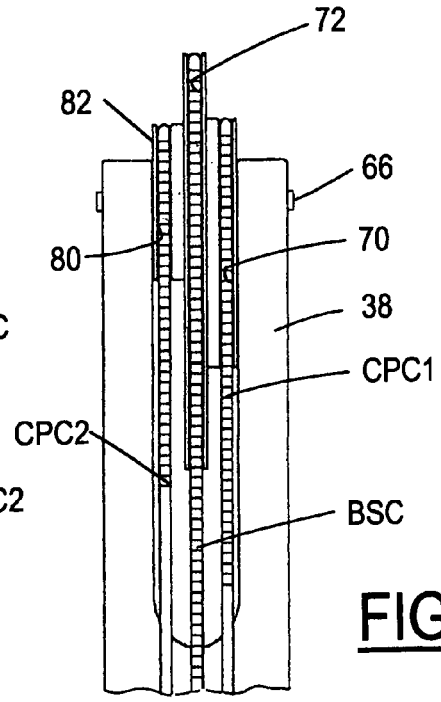
FIGS. 8 and 9 are fragmentary elevational views taken substantially from the respective directions 8 and 9 in FIG. 7.
Figure 9:
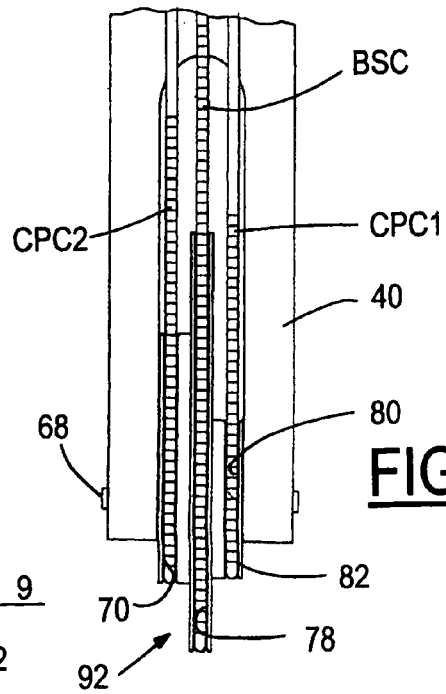

FIGS. 7–9 illustrate a dual-cam bow 90 in accordance with a further embodiment of the present invention. Power cam 62 at the end of bow limb 38 is the same as power cam 62 in embodiment of FIGS. 4–6. In the embodiment of FIGS. 4–6, power cam 64 is the mirror image of power cam 62. However, in the embodiment of FIGS. 7–9, power cam 92 at the end of bow limb 90 is identical to power cam 62 at the end of bow limb 38. As a result, as best seen in FIGS. 8 and 9, control/power cables CPC1 and CPC2 do not cross each other at the center of the bow, as they do in FIGS. 5 and 6, and the arrow is shot from bowstring cable BSC between the control/power cables. This cable configuration allows the bow to be set up with or without cable guards. Otherwise, operation of the embodiment of FIGS. 7–9 is the same as in FIGS. 4–6.

Figure 10:
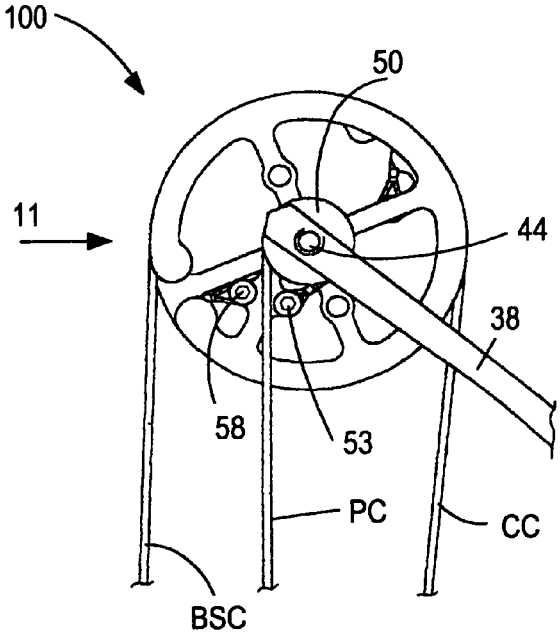
FIG. 10 is a fragmentary elevational view that illustrates a modification to the bow of FIGS. 1–3.
Figure 11:
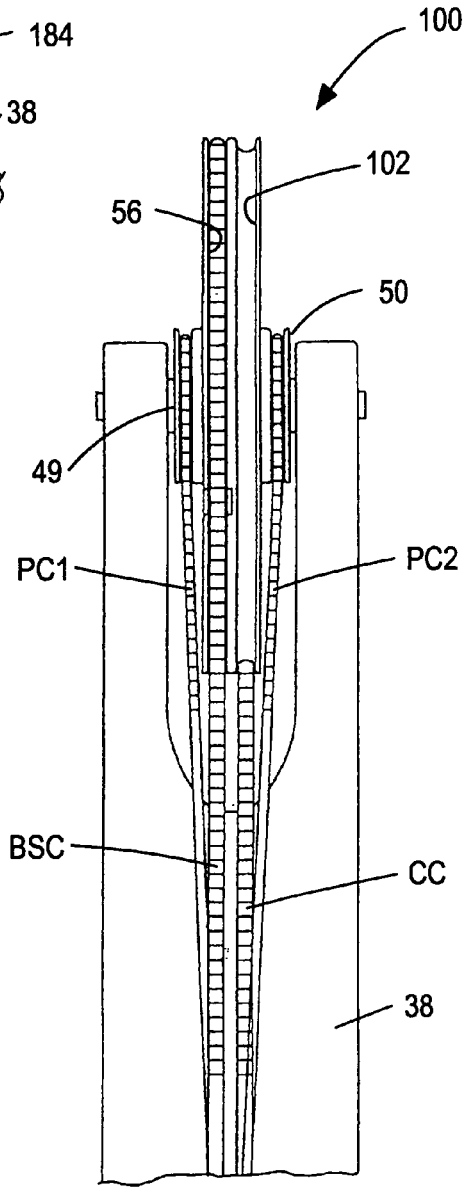
FIG. 11 is an elevational view taken from the direction 11 in FIG. 10.
Figure 10A:
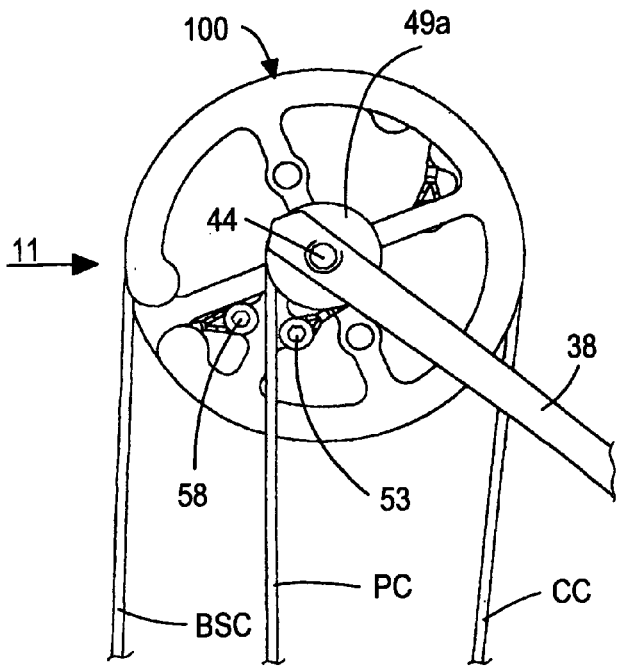
FIGS. 10A and 11A are elevational views similar to those in FIGS. 10 and 11 but illustrating a modification to the embodiment of FIGS. 10–11.
Figure 11A:
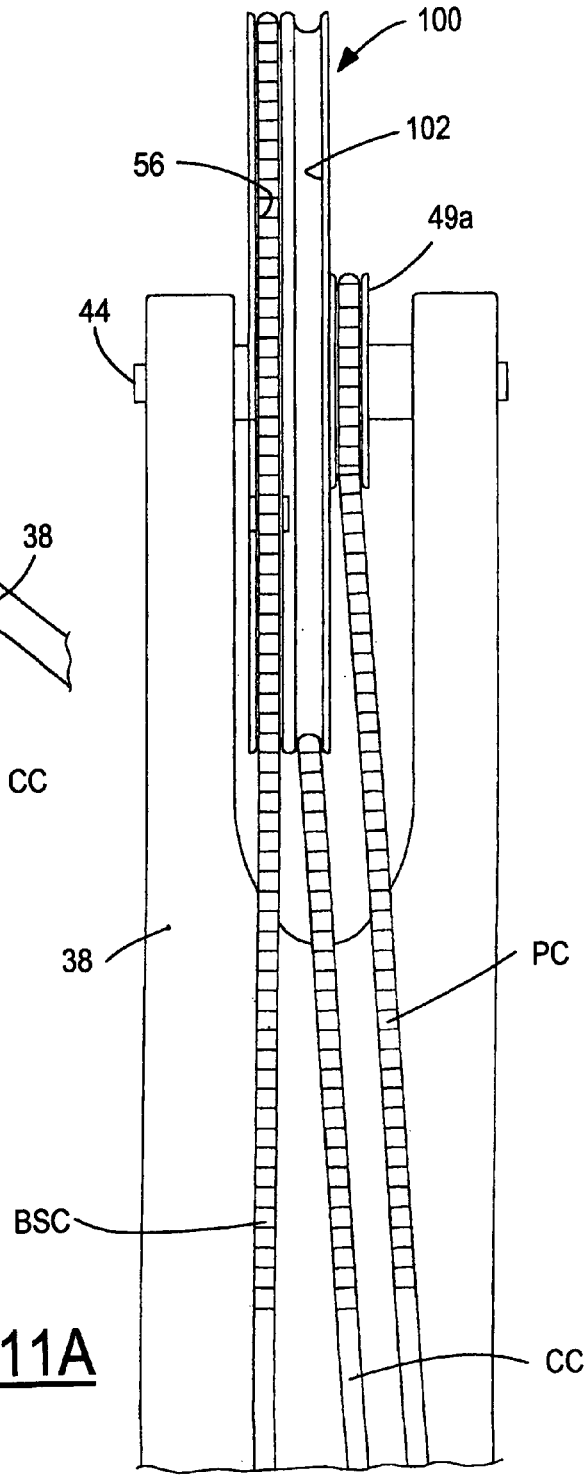
Figures 12, 13, 14, 15:
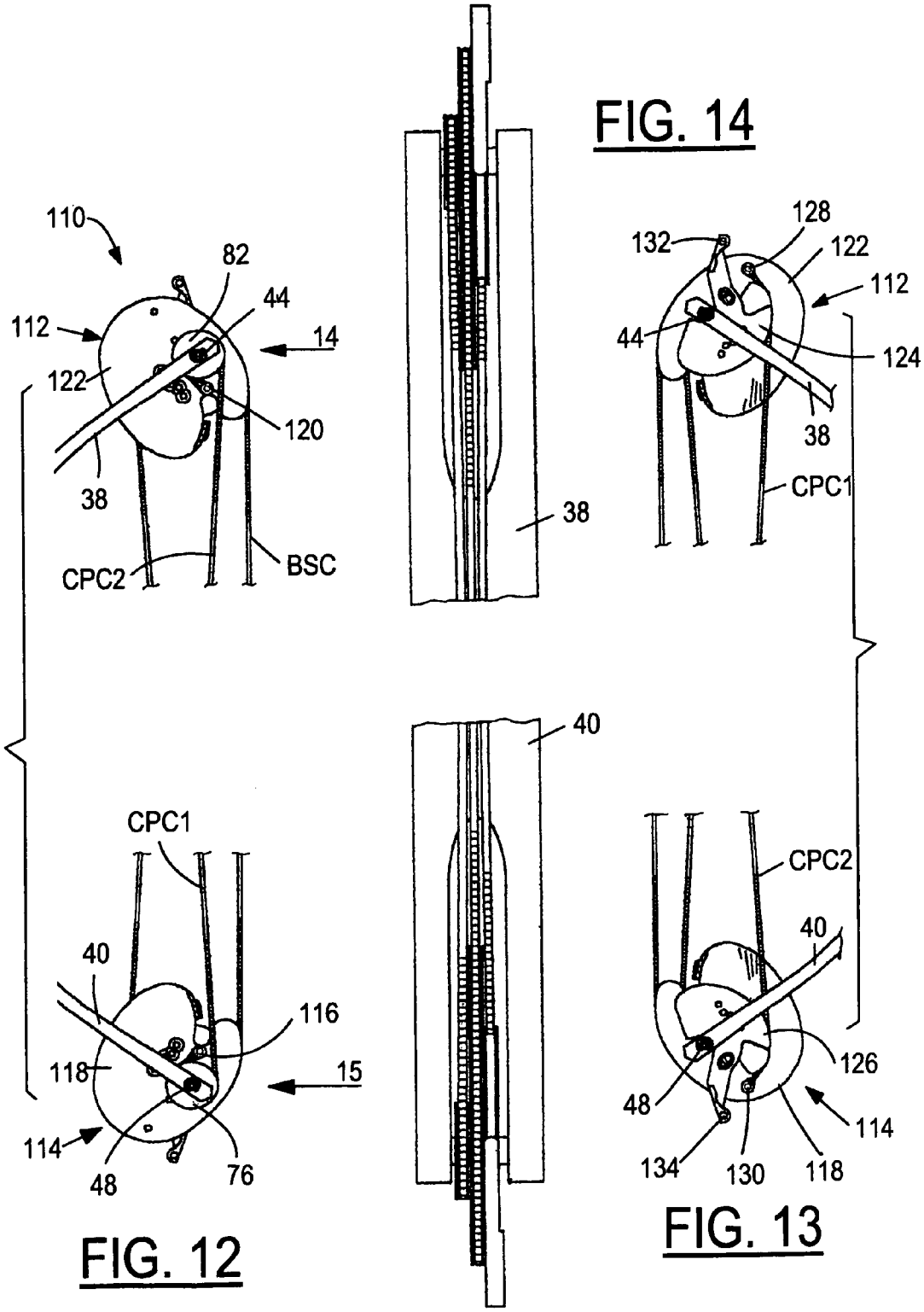
FIGS. 12 and 13 are opposing fragmentary side elevational views of a dual-cam bow in accordance with another embodiment of the invention.
FIGS. 14 and 15 are fragmentary elevational views taken from the respective directions 14, 15 in FIG. 12.

FIGS. 10 and 11 illustrate a modification to the embodiment of FIG. 1, in which the control wheel or pulley 100 at the end of bow limb 38 has a pair of peripheral grooves 56, 102 at relatively large diameter coaxial and concentric with axle 44, and a pair of side pulleys 49, 50 with peripheral let-out grooves also concentric and coaxial with axle 44. Ends PC1, PC2 of power cable PC are wound in the peripheral grooves of pulleys 49, 50. Control cable CC is wound into take-up pulley groove 102, while bowstring cable BSC is wound out of let-out pulley groove 56. Thus, as bowstring cable BSC is drawn (to the left in FIG. 10), the bowstring cable is unwound from groove 56, while power cable ends PC1, PC2 are unwound from pulleys 49, 50 and control cable CC is wound into pulley groove 102. As in the other embodiments, pulleys 49, 50 may be made as one piece with the wheel 100 that includes grooves 56, 102, or may be fabricated separately and pinned or otherwise secured to the larger wheel. Pulleys 49, 50 may be non-circular and/or non-concentric with axle 44, if desired. FIGS. 10A and 11A illustrate a modification to the embodiment of FIGS. 10 and 11 in which the separate pulleys 49, 50 of FIGS. 10 and 11, are combined into a single pulley 49*a*, and power cable PC is wrapped around pulley 49*a* and not split.

FIGS. 12–15 illustrate a dual-cam bow 110 having cams 112, 114 mounted at the respective ends of bow limbs 38, 40. Cams 110, 114 preferably are mirror images of each other in this embodiment. In this embodiment, control/power cable CPC1 is wound around a peripheral let-out groove in a pulley 76 on cam 114, and is anchored at 116 to the cam base 118. Likewise, control/power cable CPC2 is wound around a peripheral let-out groove in a pulley 82 on cam 112 and anchored at 120 to cam base 122. Each cam 112, 114 has a take-up groove or a draw-length module 124, 126 mounted on the associated cam base 122, 118. Control/power cable CPC1 engages a peripheral take-up groove on draw-length module 124, and is anchored at 128 to cam base 122. Likewise, control/power cable CPC2 engages a peripheral take-up groove on draw-length module 126, and is anchored at 130 to cam base 118. Each draw-length module 124, 126 includes an associated draw stop 132, 134 that engages the associated control/power cable when the bow is fully drawn—i.e., when the associated control/power cable is fully taken up into the associated draw-length module peripheral groove. An advantage of this embodiment of the invention lies in the fact that, if cams 112, 114 are not perfectly timed, draw of bowstring cable BSC may continue from both cams until both draw stops engage the associated control/power cables.

Figure 16:
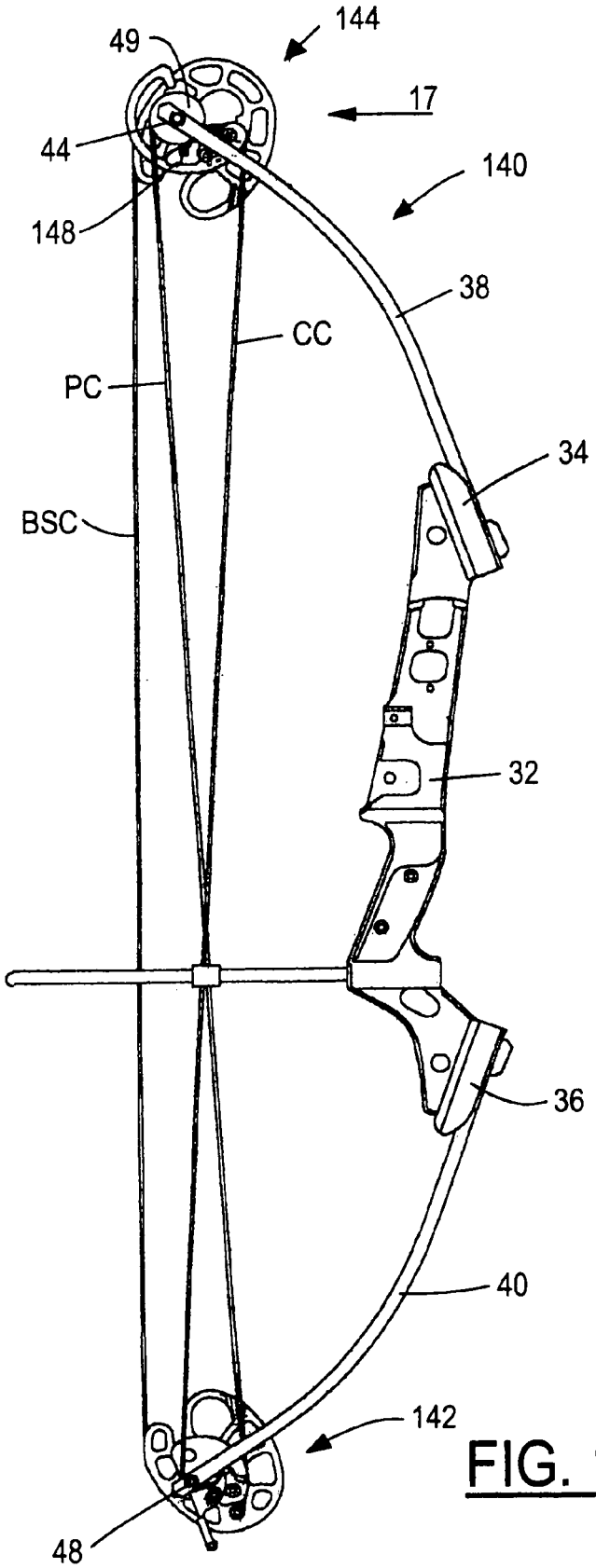
FIG. 16 is a side elevational view of a single-cam bow in accordance with another embodiment of the invention.
Figure 17:
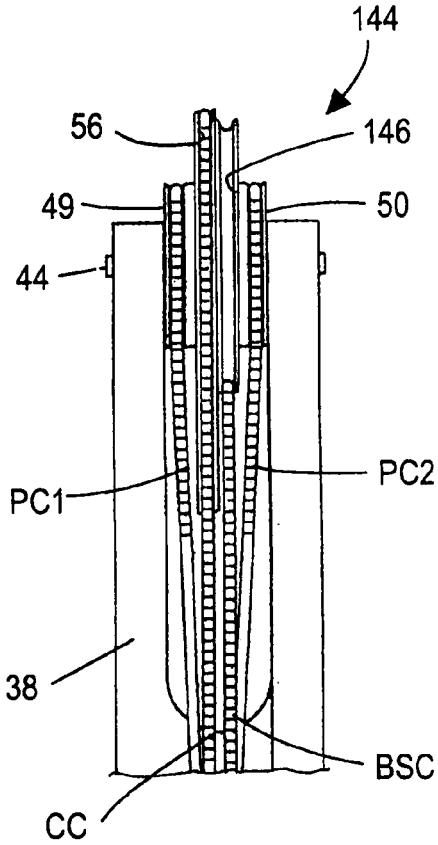
FIG. 17 is a fragmentary elevational view taken from the direction 17 in FIG. 16.

FIGS. 16 and 17 illustrate a single-cam bow 140 that has a power cam 142 at the end of bow limb 40 and a control wheel 144 at the end of limb 38. Power cam 142 is similar to cam 46 discussed in connection with FIGS. 1–3. Control wheel 144 has a peripheral bowstring cable let-out groove 56, and a peripheral control cable take-up groove 146. Power cable let-out pulleys 49, 50 have associated peripheral grooves that receive the split ends PC1, PC2 of power cable PC. The power cable ends are anchored to the opposed sides of the base of control wheel 144, as illustrated at 148 in FIG. 16. Thus, as bowstring cable BSC is drawn to the left in FIG. 16, bowstring cable BSC is let out of groove 56 on control wheel 144 and an associated groove on power cam 142, and power cable PC is let out of the peripheral grooves of pulleys 49, 50. Control cable CC is taken up into the groove 146 on control wheel 144, and let out from power cam 142. The power cable PC that is let out from pulleys 49, 50 is taken up at power cam 142. FIGS. 16A, 17A show a modification to the embodiment of FIGS. 16 and 17, in which pulleys 49, 50 are combined into a single pulley 49*a*, around which non-split power cable PC is wrapped.

Figure 18:
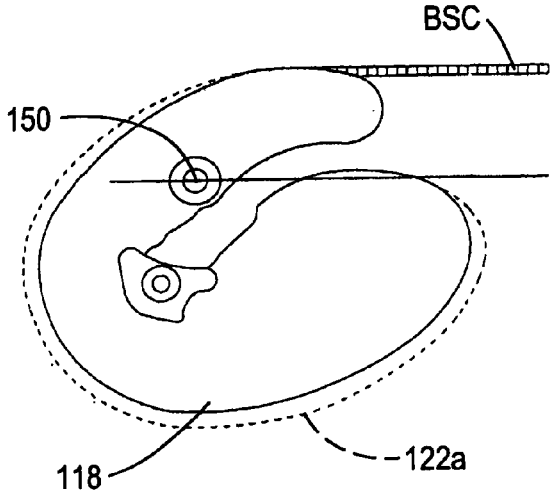
FIG. 18 is an elevational view that compares cam-base peripheries in a dual-cam bow modification to the embodiment of FIGS. 12–15.

FIG. 18 illustrates a modification to bow 110 illustrated in FIGS. 12–15. FIG. 18 compares the periphery of cam base 118 of lower cam 114 to periphery of cam base 122*a* of upper cam 110. As can be seen in FIG. 18, cam base 122*a* has a periphery that is a greater distance from the axis of rotation 150 for most but not all of the peripheries of the cam bases. The upper cam thereby lets out more cable BSC than the lower cam as the cams simultaneously rotate and the bowstring is drawn. This keeps the center portion of the bowstring, to which the arrow is nocked, parallel with the bow handle, and obtains straight-line nock travel that does not slope upwardly or downwardly with respect to the bow handle if the arrow is not drawn from the center of the bow. The bow 30 of FIGS. 1–3 and the bow 140 of FIGS. 16–17 could be modified by providing a second power cable PC, a second power cable take-up groove on the opposite side of power cam 46 or 114, and thus employing parallel power cables instead of a single split power cable as illustrated in those drawings.

Figure 19:
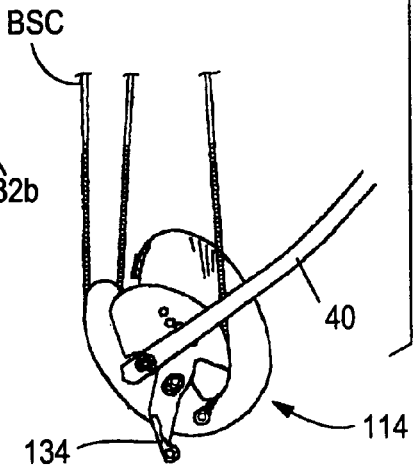
FIG. 19 is a fragmentary elevational view that illustrates another modification to the bow of FIGS. 12–15.

FIG. 19 illustrates a bow 160 that is a modification to the bow 110 illustrated in FIGS. 12–15. In the bow 160, the lower cam 114 is the same as in FIGS. 12–15, while the upper cam 112*a* is similar to cam 112 but does not include a draw stop (132 in FIG. 13). This modification takes advantage of the fact that the system eliminates the problem of timing between the upper and lower cams, and the problem of non-linear nock travel if one draw stop is engaged on one cam but not on the other.

Figure 20:
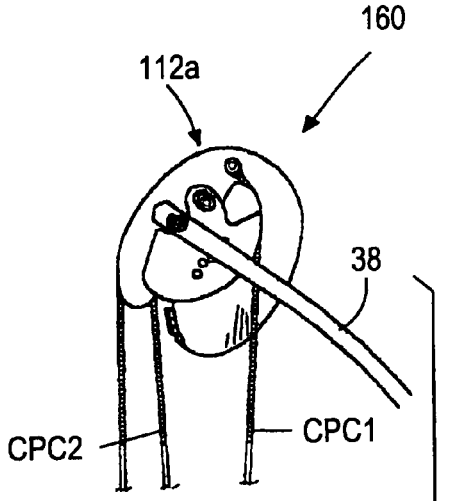
FIG. 20 is a top plan view of a crossbow that embodies the principles of the present invention.
Figure 20:
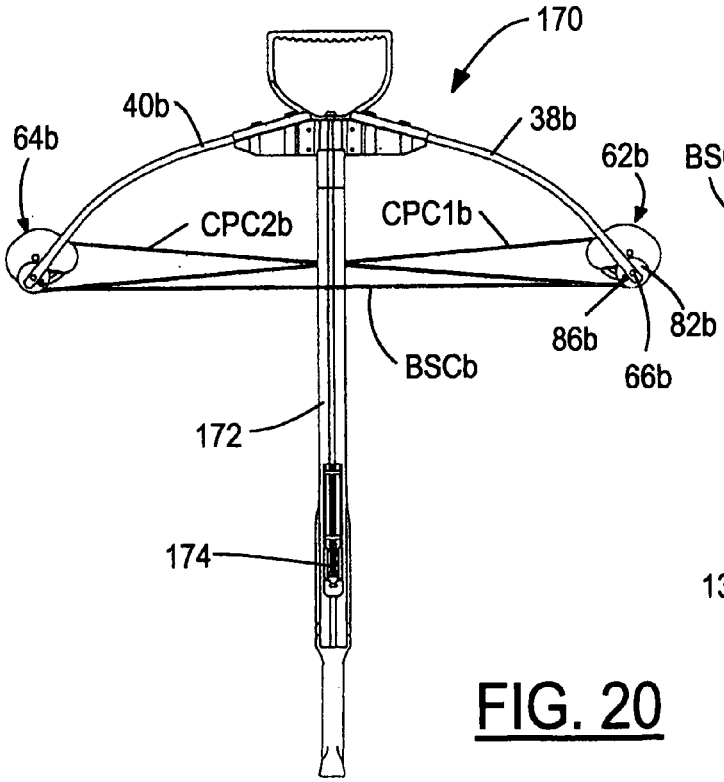
Figure 21:
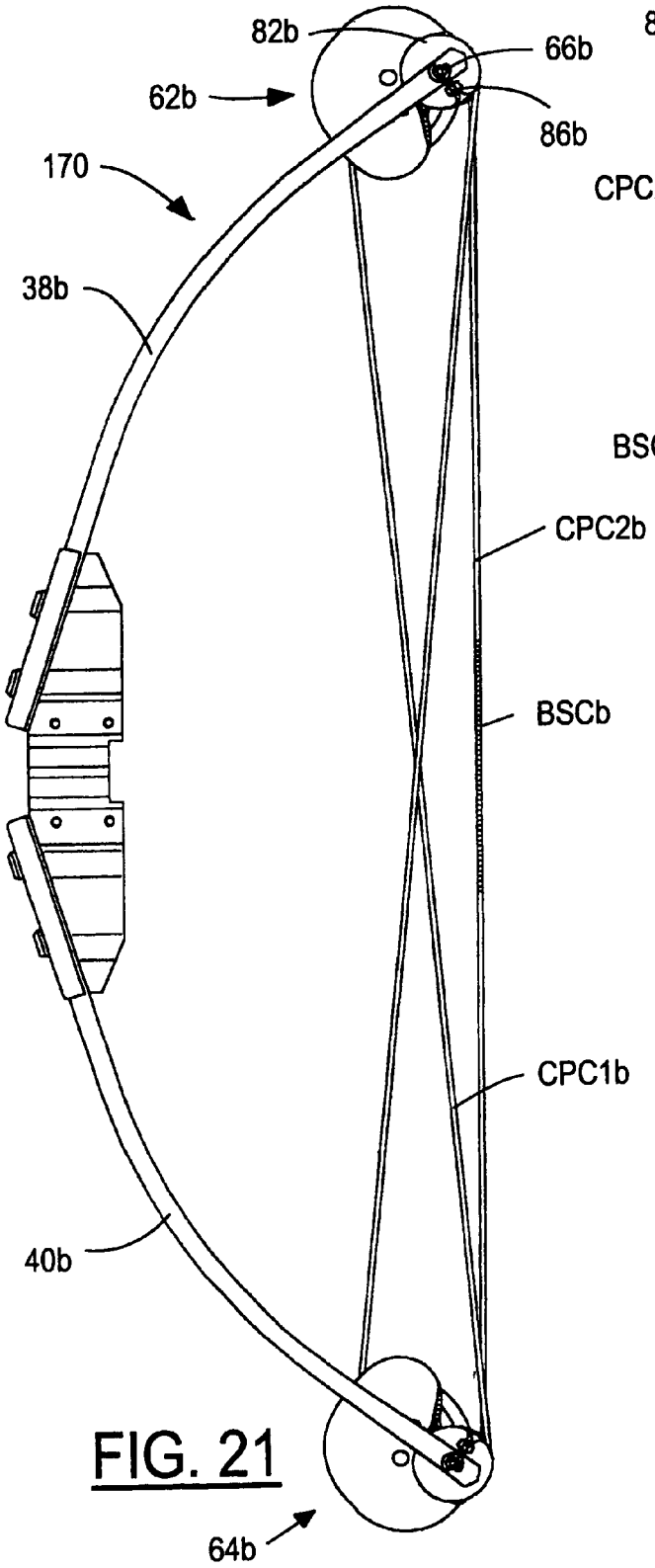
FIGS. 21 and 22 are top plan and side elevational views of the crossbow front assembly in the crossbow of FIG. 20.
Figure 22:
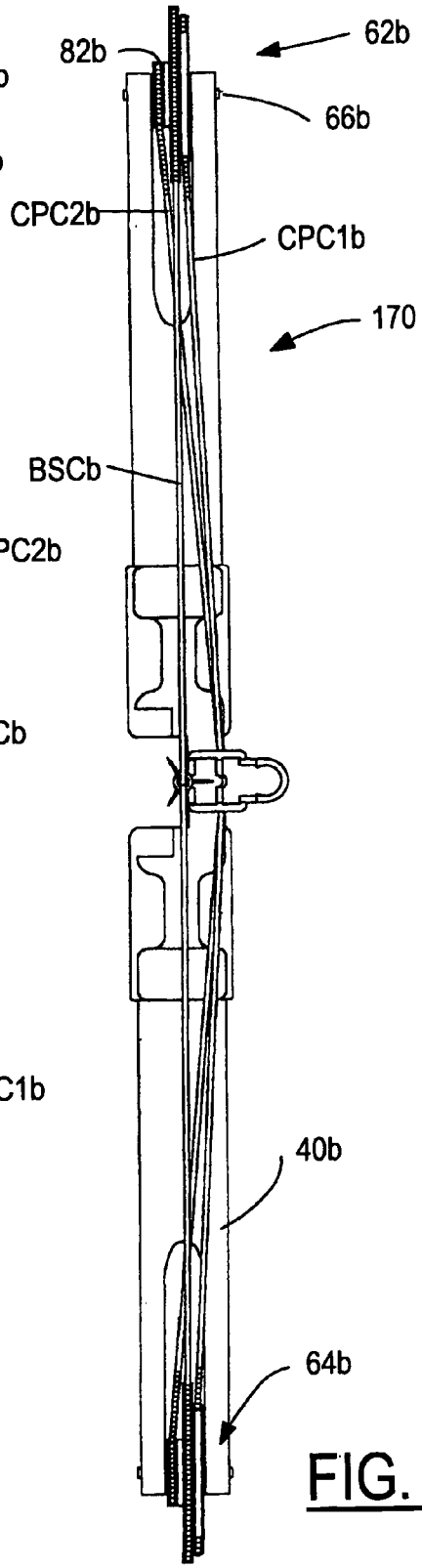

FIGS. 20, 21 and 22 illustrate a crossbow 170 that embodies the principles of the present invention, particularly as illustrated in the embodiment of FIGS. 4–6. Elements in the crossbow 170 of FIGS. 20–22 that correspond to the elements of the bow 60 in FIGS. 1–6 are indicated by correspondingly identical reference numerals followed by the suffix "b." The stock 172 and the trigger mechanism 174 preferably are as illustrated in U.S. Pat. No. 5,884,614. The crossbow alternatively could embody the cam and control wheel configurations illustrated in any of the other drawing figures.

Figure 20A:
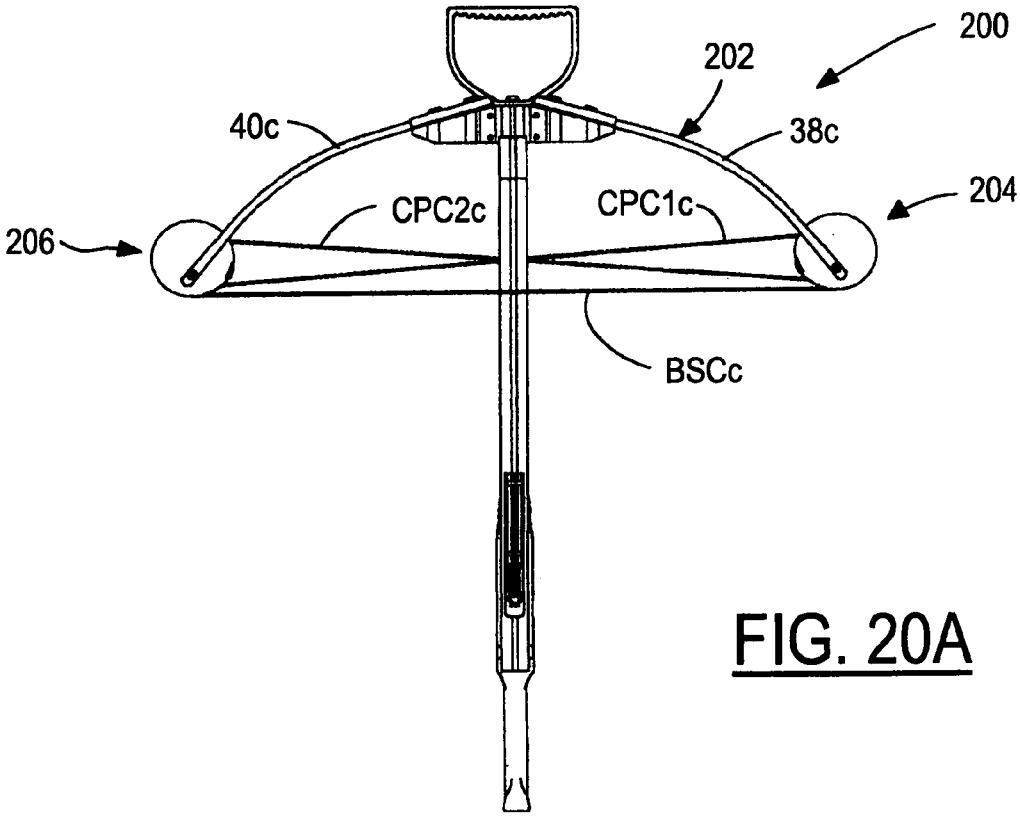
FIGS. 20A, 21A and 22A are views respectively similar to those in FIGS. 20–22 but illustrating a modification to the embodiment of FIGS. 20–22.
Figure 20B:
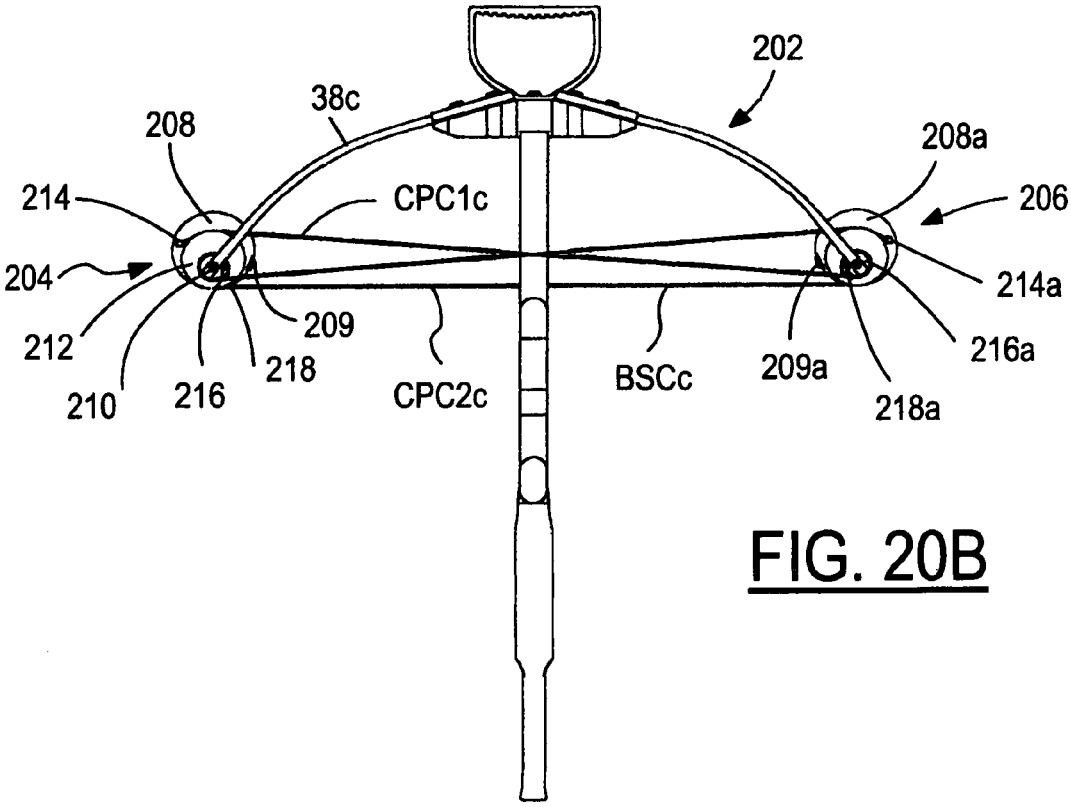
FIG. 20B is a bottom plan view of the bow in FIGS. 20A–22A.
Figure 21A:
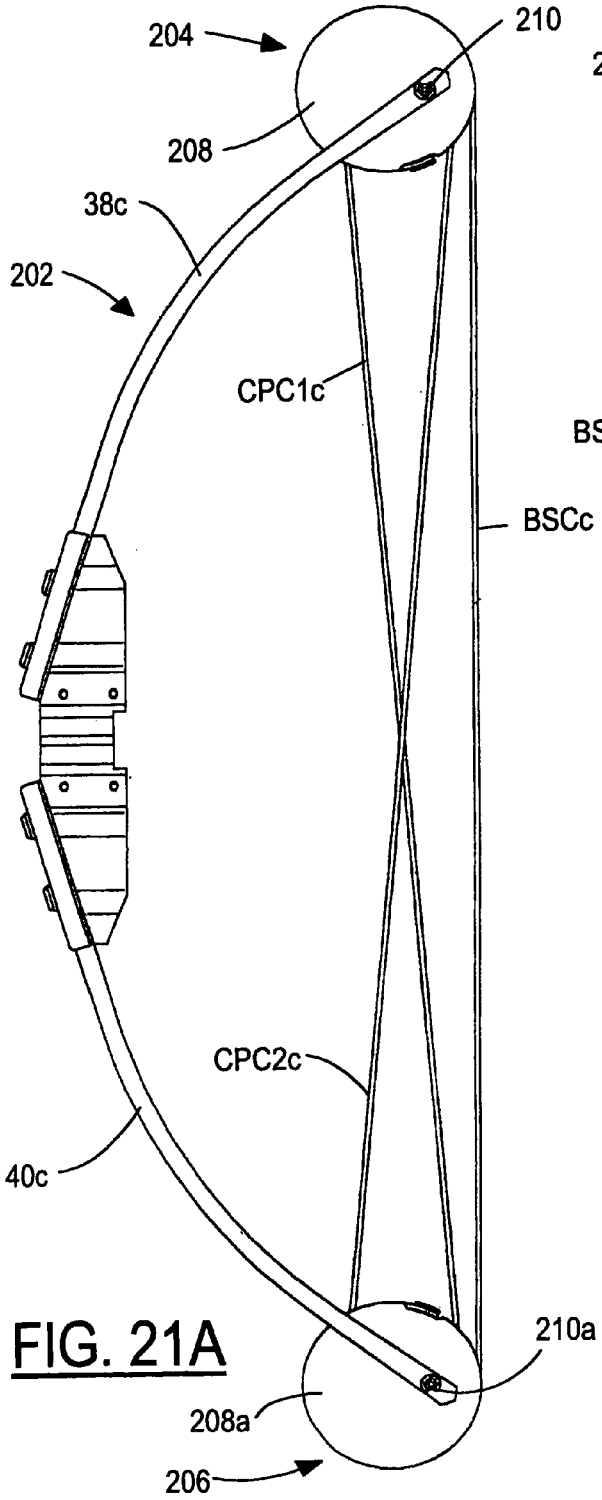
Figure 22A:
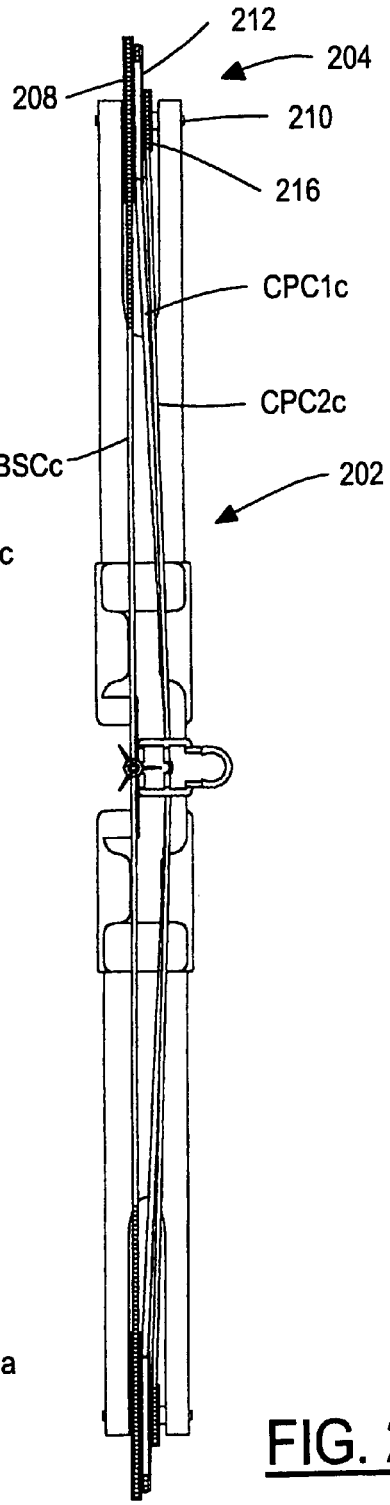

FIG. 20A is a top plan view of a crossbow 200 in accordance with another embodiment of the invention, FIG. 20B is a bottom plan view of the crossbow 200, and FIGS. 21A and 22A show the crossbow front assembly 202 in the crossbow 200. Elements in FIGS. 20A, 20B, 21A and 22A that are similar to those in FIGS. 20–22 are indicated by correspondingly identical reference numerals with the suffix "c". Bow 200 has a pair of power cams 204, 206 mounted on the ends of the respective bow limbs 38*c*, 40*c*. Cams 204, 206 are mirror images of each other. In cam 204, bowstring cable BSCc is wound around a peripheral groove on a cam base 208, which has a circular peripheral groove that is eccentric to the axle 210 on which cam 204 is mounted to bow limb 38*c*. Control power cable CPC1*c* is wound around the circular peripheral groove on a pulley 212 and anchored at 214 to base 208. Cable CPC2*c* is wound around a pulley 216 and anchored at 218. Pulley 216 has a circular peripheral groove that is concentric with axle 210. The circular peripheral grooves of pulley 212 and base 208 are eccentric to axle 210 and to each other. The mirror image of this arrangement is provided at cam 206, with cable CPC2*c* being anchored at 214*a* on base pulley 208*a*, bowstring cable BSCc being trained around base pulley 208*a* and anchored at 209*a*, and cable CPC1*c* being trained around pulley 216*a* and anchored at 218*a*. Pulleys 208, 212, 216 (and pulleys 208*a*, 212*a* and 216*a*) preferably are constructed as a single unit.

Figure 23:
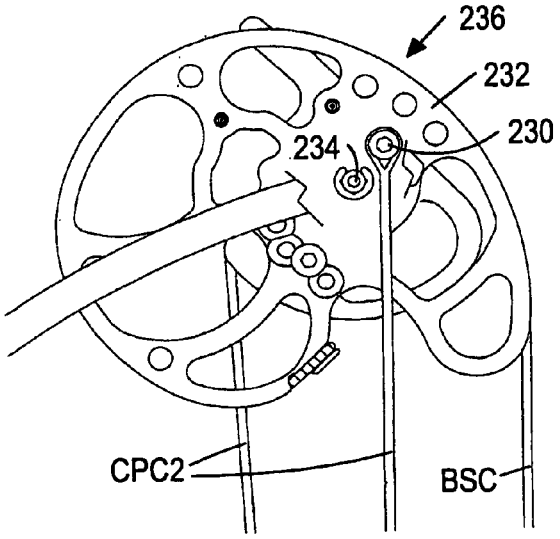
FIGS. 23–26 are fragmentary elevational views that illustrate respective further embodiments of the invention.
Figure 25:
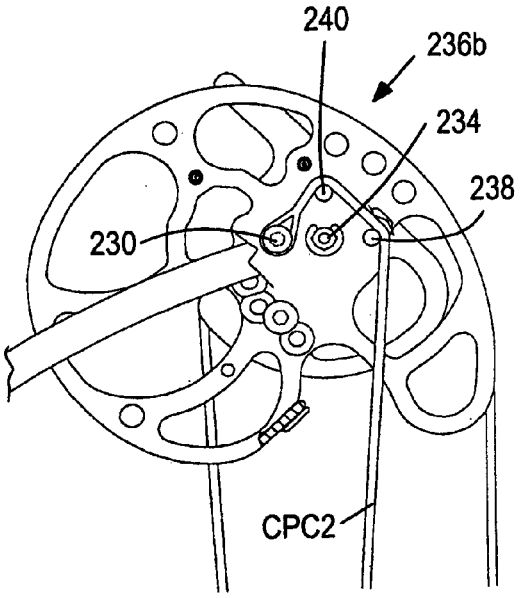
Figure 24:
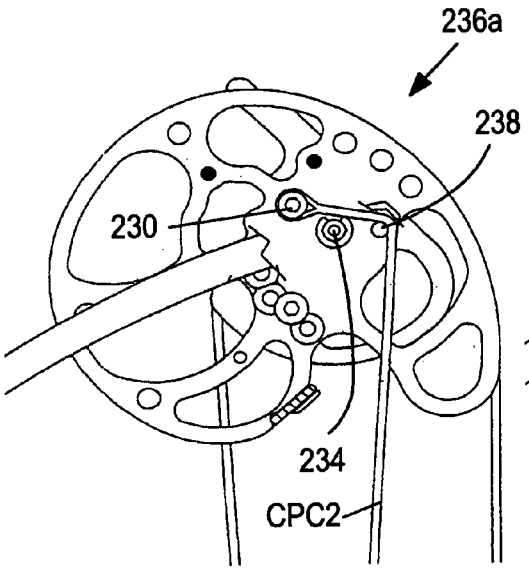
Figure 26:
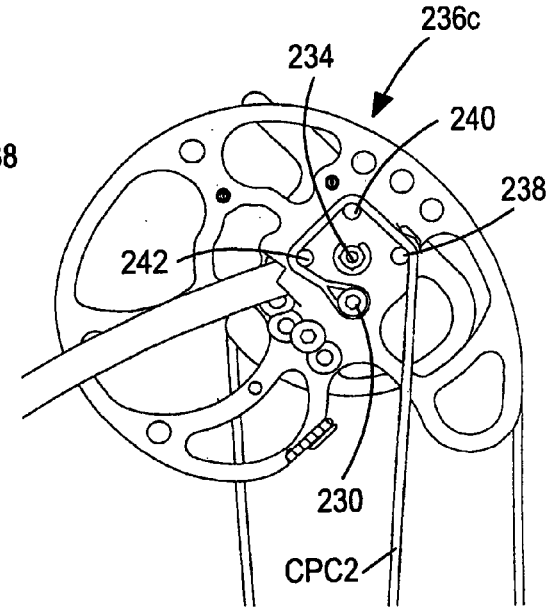
Figure 30:
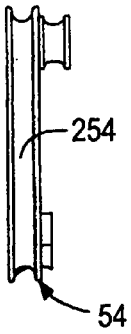

FIGS. 23–26 illustrate respective modifications to the embodiment of FIGS. 4A, 5A, 6A and 6B, for example, in which the power/control cable let-out means comprises one or more posts secured to the pulley offset from the axis of rotation. In FIG. 23, for example, control/power cable CPC2 is anchored to a post 230 on cam base 232 at a position offset from axle 234 that defines the axis of rotation. As bowstring cable BSC is drawn (to the right in FIG. 23), pulley 236 rotates clockwise around axle 234 and cable CPC2 is let out from the pulley. At the extreme end of bowstring cable draw, as post 230 moves beneath axle 234 and back up, cable CPC2 may be taken up. In the pulley 236*a* of FIG. 24, cable 238 extends to post 230 around an intermediate post 238. In pulley 236*b* of FIG. 25, cable CPC2 extends to post 230 around two angularly spaced intermediate posts 238, 240. In pulley 236*c* of FIG. 26, cable CPC2 extends to post 230 around three angularly spaced intermediate posts 238, 240, 242. The intermediate posts reduce or eliminate the amount of cable CPC2 taken up at the end of the draw stroke.

Figure 27:
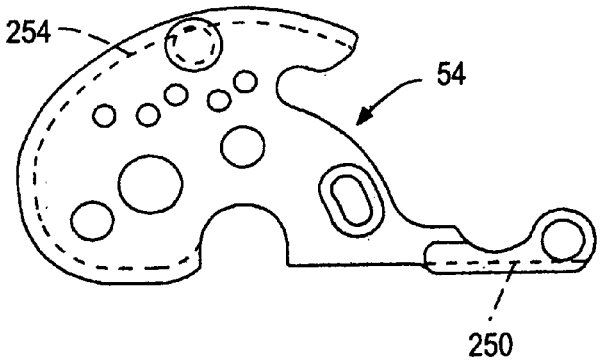
FIG. 27 is an elevational view of the draw length adjustment module in the bow of FIG. 16.
Figure 29:
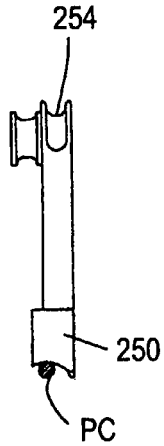
Figure 28:
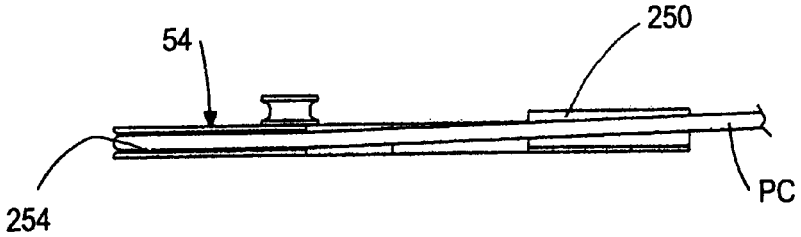
FIG. 28 is a fragmentary elevational view of a power cable engaging the draw stop in the module of FIG. 27, and FIGS. 29 and 30 are opposed end views of the module in FIG. 27.

FIGS. 27–29 illustrate draw length module 54 (FIG. 1, or 87 in FIG. 6B, or 124, 126 in FIG. 13) in greater detail. A draw stop 250 extends from module 54 for abutment with power cable PC (or cables CPC1, CPC2 in FIGS. 12–14). In bows having a cable guard 252 (FIG. 1) cable PC (or cable CPC1 in FIG. 6B, or CPC1, CPC2 in FIG. 13) extends at an angle from let-out groove 254 on module 54—i.e., at an angle to the plane of the draw length module as shown in FIG. 28. In accordance with a further aspect of the invention, the cable abutment surface 256 of draw stop is concave and angled (see FIG. 29) to maintain cable PC1 (or CPC1 or CPC2) in groove 254 at the extreme end of cable draw.

There thus has been disclosed a compound archery bow that fully satisfies all of the objects and aims previously set forth. The invention has been disclosed in conjunction with several presently preferred embodiments thereof, and additional modifications and variations have been discussed. Other modifications and variations will readily suggest themselves to persons of ordinary skill in the art in view of the foregoing discussion. The invention is intended to embrace these and all other modifications and variations as fall within the spirit and broad scope of the appended claims.

The invention claimed is:

1. A compound archery bow that includes:

a handle having projecting limbs, a first pulley mounted on a first of said limbs for rotation around a first axis, a second pulley mounted on a second of said limbs for rotation around a second axis, and bow cable means including a bowstring cable extending from bowstring let-out grooves on said first and second pulleys, a first cable extending from a cable take-up groove on said first pulley to second cable let-out means on said second pulley, and a second cable extending from a cable take-up groove in said second pulley to first cable let-out means on said first pulley such that draw of said bowstring cable away from said handle lets out bowstring cable from said let-out grooves on said first and second pulleys, rotates on said first and second pulleys around said axes, and lets out portions of said first and second cables from said first and second cable let-out means on said first and second pulleys, wherein at least one of said bowstring let-out grooves and/or at least one of said cable take-up grooves is non-circular.

2. The bow set forth in claim 1 wherein at least one of said first and second let-out means comprises at least one let-out groove.

3. The bow set forth in claim 2 wherein said at least one let-out groove is circular and concentric with the axis of said at least one pulley.

4. The bow set forth in claim 3 wherein said at least one let-out groove comprises a pair of circular let-out grooves disposed on opposite sides of the bowstring let-out groove on said pulley.

5. The bow set forth in claim 4 wherein at least one of said first and second pulleys includes a draw stop adjacent to the cable take-up groove in said pulley for engaging the cable taken up into said groove to arrest draw of said bow, and wherein said draw stop includes a concave abutment face for engaging said cable.

6. The bow set forth in claim 1 wherein at least one of said first and second let-out means comprises at least one post mounted on one of said first and second pulleys offset from the associated axis.

7. The bow set forth in claim 1 wherein, on at least one of said first and second pulleys, said take-up groove and said let-out means are on opposite ends of said bowstring let-out groove.

8. The bow set froth in claim 1 wherein, on at least one of said first and second pulleys, said take-up groove is non-circular.

9. The bow set forth in claim 1 wherein each of said pulleys includes a base having a periphery on which said bowstring let-out grooves are disposed, said bowstring let-out grooves on said pulleys being differently dimensioned with respect to the associated axes.

10. The bow set forth in claim 1 wherein at least one of said bowstring let-out grooves is non-circular.

11. The bow set forth in claim 1 wherein at least one of said cable take-up grooves is non-circular.

* * * * *